US011714360B2

(12) United States Patent
Furukawa

(10) Patent No.: US 11,714,360 B2
(45) Date of Patent: Aug. 1, 2023

(54) LUSTROUS DEVELOPER, DEVELOPER CONTAINER, DEVELOPMENT DEVICE, AND IMAGE FORMATION APPARATUS

(71) Applicant: Oki Data Corporation, Tokyo (JP)

(72) Inventor: Yuichi Furukawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 311 days.

(21) Appl. No.: 17/171,992

(22) Filed: Feb. 9, 2021

(65) Prior Publication Data

US 2021/0263433 A1 Aug. 26, 2021

(30) Foreign Application Priority Data

Feb. 21, 2020 (JP) ..... 2020-028645

(51) Int. Cl.
*G03G 9/09* (2006.01)
*G03G 9/08* (2006.01)
*G03G 9/087* (2006.01)

(52) U.S. Cl.
CPC ..... *G03G 9/0819* (2013.01); *G03G 9/08755* (2013.01); *G03G 9/0902* (2013.01); *G03G 2215/0614* (2013.01)

(58) Field of Classification Search
CPC ... G03G 9/0902; G03G 9/0819; G03G 9/0827
See application file for complete search history.

(56) References Cited

FOREIGN PATENT DOCUMENTS

JP 2018-084677 A 5/2018
JP 2019-159125 * 9/2019 ..... G03G 9/08

OTHER PUBLICATIONS

Translation of JP 2019-159125.*

* cited by examiner

*Primary Examiner* — Peter L Vajda
(74) *Attorney, Agent, or Firm* — Metrolex IP Law Group, PLLC

(57) ABSTRACT

A lustrous developer according to an embodiment may include: a metallic pigment; and a binder resin. The lustrous developer includes small diameter particles smaller than a volume median diameter of the metallic pigment. A ratio of a volume of particles other than the small diameter particles in the lustrous developer to a volume of the entire lustrous developer is 90.297% or more and 99.314% or less. The volume median diameter of the metallic pigment is 5.91 μm or less.

11 Claims, 8 Drawing Sheets

RESULT OF MEASUREMENT AND EVALUATION ON EACH DEVELOPER

| DEVELOPER | VOLUME MEDIAN DIAMETER OF PIGMENT IN DEVELOPER [μM] | VOLUME MEDIAN DIAMETER OF DEVELOPER [μM] |
|---|---|---|
| DEVELOPER Da | 8. 69 | 16. 52 |
| DEVELOPER Db | 8. 69 | 16. 16 |
| DEVELOPER Dc | 8. 69 | 14. 26 |
| DEVELOPER Dd | 5. 80 | 12. 76 |
| DEVELOPER De | 5. 37 | 16. 15 |
| DEVELOPER Df | 5. 37 | 15. 70 |
| DEVELOPER Dg | 5. 37 | 8. 40 |

FIG. 5

RESULT OF MEASUREMENT AND EVALUATION ON METALLIC PIGMENT EXTRACTED FROM EACH DEVELOPER

| DEVELOPER | VOLUME MEDIAN DIAMETER OF PIGMENT IN DEVELOPER [μM] | VOLUME MEDIAN DIAMETER OF EFFECTIVE COMPONENTS IN DEVELOPER [μM] | TRANSFER DROPOUT LEVEL [Lv.] | TRANSFER DROPOUT JUDGMENT | RATIO OF VOLUME OF PERTICLES NOT SMALLER THAN VOLUME MAIDN DIAMETER OF PIGMENT IN DEVELOPER TO VOLUME OF ENTIRE DEVELOPER [%] |
|---|---|---|---|---|---|
| DEVELOPER Da | 8.93 | 16.11 | 3.6 | POOR | 90.297 |
| DEVELOPER Db | 8.93 | 16.23 | 4.6 | POOR | 98.583 |
| DEVELOPER Dc | 8.93 | 14.55 | 5.2 | POOR | 97.752 |
| DEVELOPER Dd | 5.91 | 12.90 | 7.6 | GOOD | 97.591 |
| DEVELOPER De | 5.44 | 16.28 | 6.6 | POOR | 99.314 |
| DEVELOPER Df | 5.44 | 15.81 | 7.0 | GOOD | 97.682 |
| DEVELOPER Dg | 5.44 | 8.81 | 8.6 | GOOD | 90.733 |

FIG. 6A FIG. 6B FIG. 6C

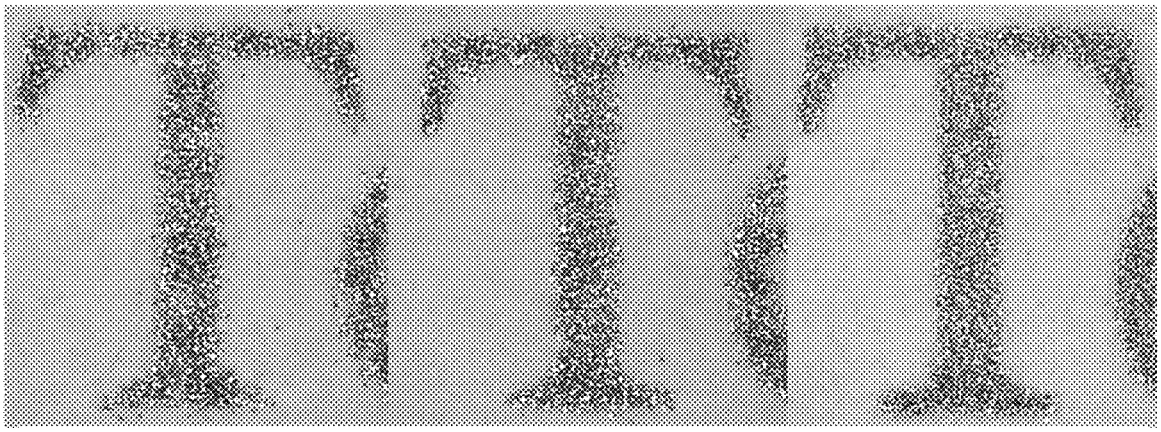

DEVELOPER Db DEVELOPER De DEVELOPER Dg

METHOD (1) OF CALCUTATING VOLUME MEDIAN DIAMETER OF DEVELOPER EFFECTIVE COMPONENTS

METHOD (1) OF CALCUTATING VOLUME MEDIAN DIAMETER OF DEVELOPER EFFECTIVE COMPONENTS

LUSTROUS DEVELOPER, DEVELOPER CONTAINER, DEVELOPMENT DEVICE, AND IMAGE FORMATION APPARATUS

CROSS REFERENCE TO RELATED APPLICATIONS

This application claims priority based on 35 USC 119 from prior Japanese Patent Application No. 2020-028645 filed on Feb. 21, 2020, entitled "LUSTROUS DEVELOPER, DEVELOPER CONTAINER, DEVELOPMENT DEVICE, AND IMAGE FORMATION APPARATUS", the entire contents of which are incorporated herein by reference.

BACKGROUND

The disclosure may relate to a lustrous developer, a developer container, a development device, and an image formation apparatus that are suitable for application to an electrophotographic printer, for example.

In a related art, an image formation apparatus (may be referred to a printer) is widely spread, which performs printing, by forming a developer image (a toner image) using a developer (or a toner) with an image formation unit based on image data supplied from a computer, an external device, or the like, transferring the developer image to a medium such as paper, and then applying heat and pressure to the developer image to fix the developer image to the medium.

Among such image formation apparatus, there is an image formation apparatus that uses a lustrous developer, which is a developer containing a lustrous pigment comprising a metallic pigment, in order to form a lustrous image, that is an image having a metallic luster such as a gold or silver color (see, for example, Patent Document 1). Particle sizes of such a metallic pigment are sufficiently large compared to those of normal color pigments.

Patent Document 1: Japanese Patent Application Publication No. 2018-84677

SUMMARY

However, since the lustrous developer contains the metallic pigment, it may be difficult to make the lustrous developer highly charged. Therefore, a print defect called a "transfer dropout" may be occurred in a printed image, in which the lustrous developer is not properly transferred to a printing medium. Thus, when such a lustrous developer containing a metallic pigment is used in an image formation apparatus, the print quality may be degraded.

An object of an embodiment of the disclosure may be to propose a lustrous developer, a developer container, a development device, and an image formation apparatus that can enhance a print quality with the lustrous developer containing a metallic pigment.

A first aspect of the disclosure may be a lustrous developer that contains a metallic pigment and a binder resin. The lustrous developer may include small diameter particles whose particle sizes are smaller than a volume median diameter of the metallic pigment in the lustrous developer, wherein a ratio of a volume of particles other than the small diameter particles in the lustrous developer to a volume of the entire lustrous developer is 90.297% or more and 99.314% or less, and the volume median diameter of the metallic pigment is 5.91 μm or less.

A second aspect of the disclosure may be a developer container that contains therein the lustrous developer according the first aspect.

A third aspect of the disclosure may be a development device that may include: an image carrier configured to form a latent image with reception of irradiation of light; a developer carrier configured to supply the lustrous developer according to the first aspect to the image carrier to develop the latent image with the lustrous developer.

A fourth aspect of the disclosure may be an image formation apparatus that may include: a development device according to the third aspect; and a fixation device configured to fix a developer image formed by the development device to a medium.

According to at least one of the above aspects, since the lustrous developer described above is used, it is possible to form a print image with a transfer dropout being suppressed and thus to form the print image having high-quality on a medium.

Accordingly, it is possible to realize a lustrous developer, a developer container, a development device, and an image formation apparatus that can enhance print quality even through the developer contains a metallic pigment.

BRIEF DESCRIPTION OF DRAWINGS

FIG. 5 is a table illustrating results of measurement and evaluation on a metallic pigment taken from each of the developers Da to Dg.

FIGS. 6A to 6C are a diagrams illustrating transfer dropout levels of the developers Db, De, and Dg.

DETAILED DESCRIPTION

Figure 1:
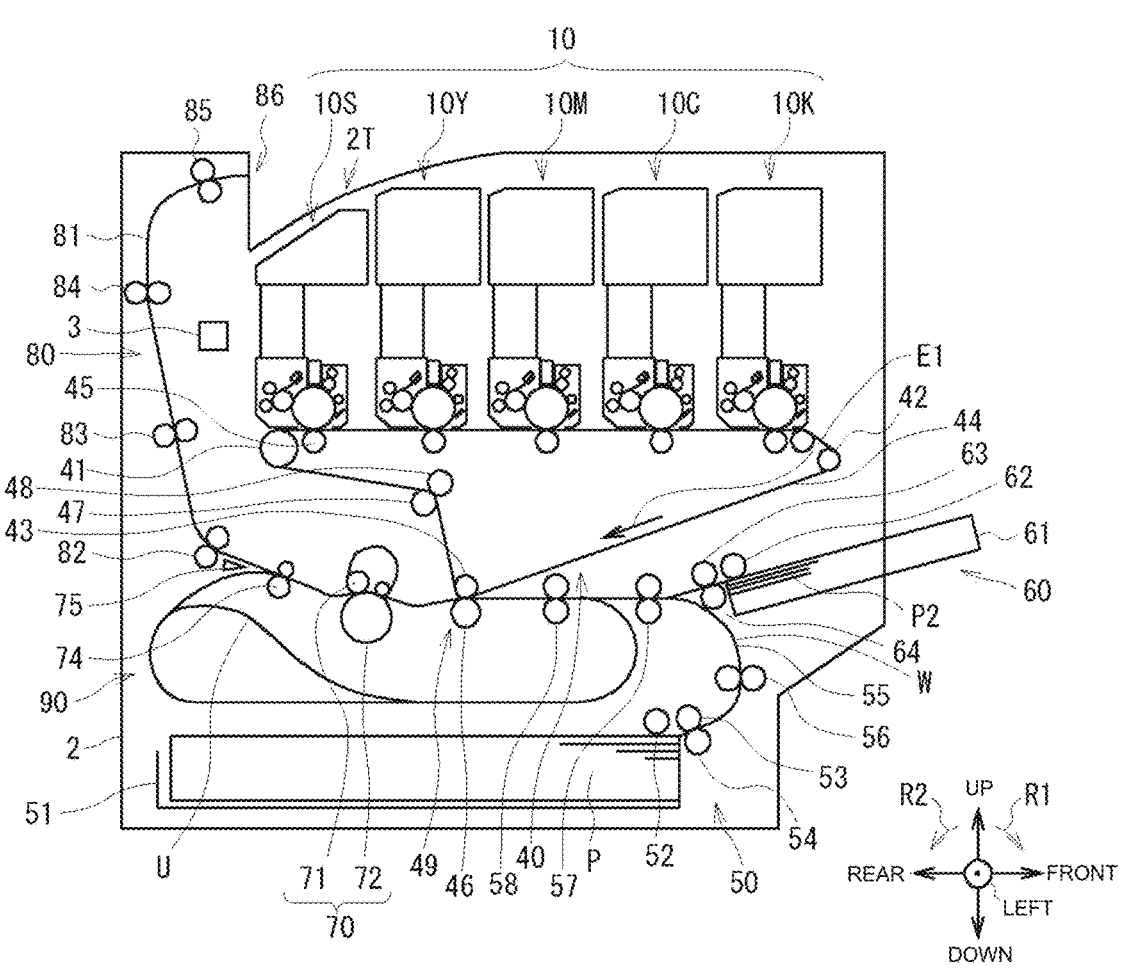
FIG. 1 is a diagram illustrating a left side view of a configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Configuration of Image Formation Apparatus

As illustrated in FIG. 1, an image formation apparatus 1 according to an embodiment is an electrophotographic printer, which is capable of forming (i.e., printing) a color image on paper P as a medium. Note that the image formation apparatus 1 illustrated in FIG. 1 is a single function printer (SFP) having a printer function, without having an image scanner function to read a document, a communication function using a telephone line, or the like.

The image formation apparatus 1 includes various parts arranged inside a housing 2 (an apparatus housing) substantially formed in a box shape. In the following description, the rightmost portion in FIG. 1 is the front of the image formation apparatus 1, and the vertical, horizontal, and front-rear directions are defined as seen facing the front.

A controller 3 controls an overall of the image formation apparatus 1. The controller 3 includes a CPU (Central Processing Unit), ROM (Read Only Memory), RAM (Random Access Memory) and the like, which are not illustrated in the figure, and executes various processes by reading and executing predetermined programs. The controller 3 is connected wirelessly or by wire to an external apparatus (not illustrated) such as a computer device. When image data representing an image to be printed and an instruction to print based on the image date are received from the external device, the controller 3 performs a printing process of forming a print image on a surface of the paper P.

At an upper portion in the housing 2, five image formation units 10K, 10C, 10M, 10Y and 10S are arranged in order from the front side to the rear side. The image formation units 10K, 10C, 10M, 10Y, and 10S respectively correspond to a black color (K), a cyan color (C), a magenta color (M), a yellow color (Y), and a special color (S), but are different only in color and have the configuration same as each other.

Black (K), cyan (C), magenta (M) and yellow (Y) are all colors used in general color printers (hereinafter referred to as normal colors). On the other hand, the special color (S) is a special color, such as white, clear (transparent or colorless), silver, or the like. For convenience of explanation, the image formation units 10K, 10C, 10M, 10Y, and 10S are hereinafter also referred to as the image formation unit 10.

Figure 2:
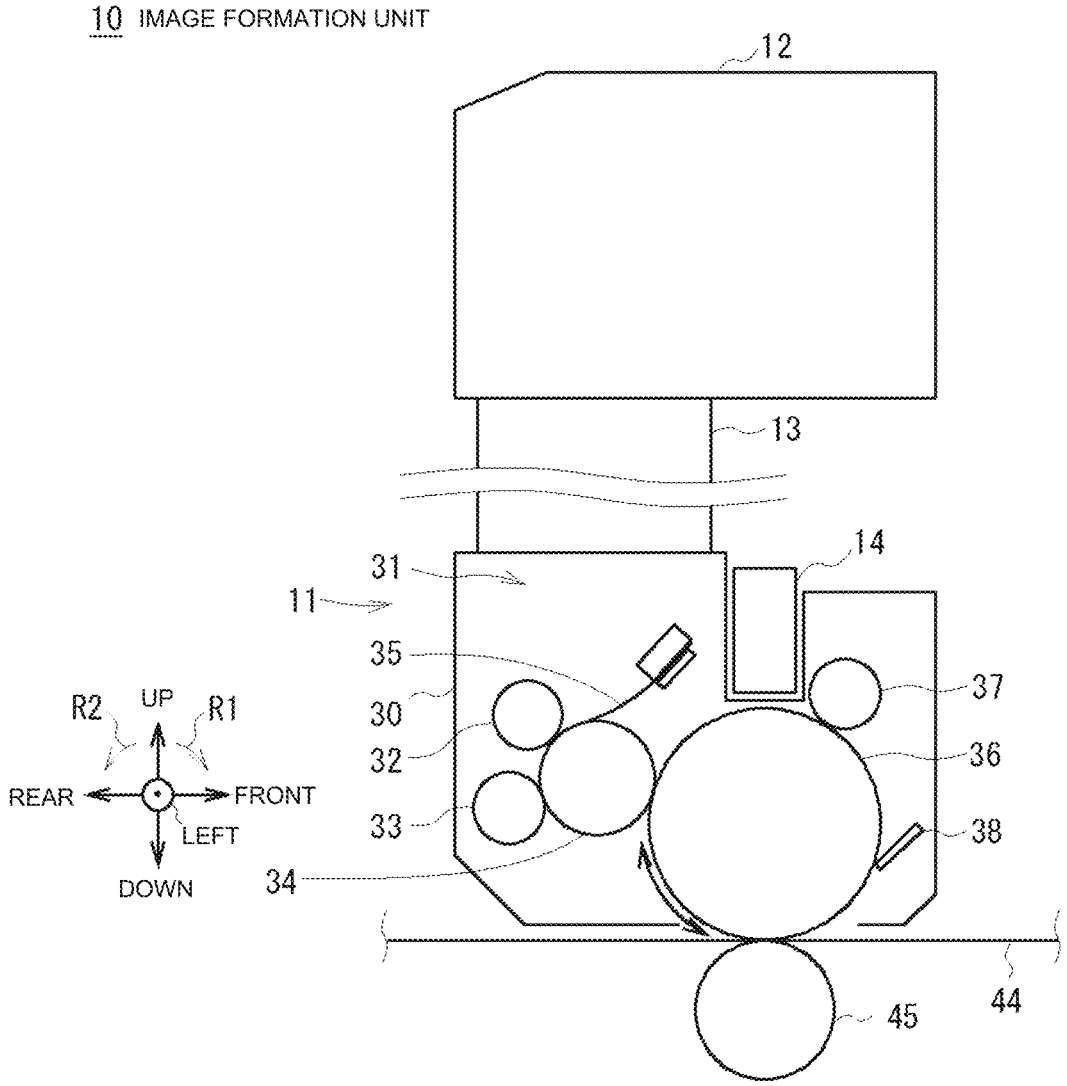
FIG. 2 is a cross-sectional view illustrating a configuration of an image formation unit.

As illustrated in FIG. 2, the image formation unit 10 generally includes an image formation unit main body 11, a developer container 12, a developer supply unit 13, and an LED (Light Emitting Diode) head 14. Incidentally, the image formation unit 10 and each component thereof has a sufficient length in the left-right direction in accordance with the length in the left-right direction of the paper P. For this reason, many of the components have a relatively long length in the left-right direction compared to the lengths in the front-back direction and in the up-down direction, and thus are formed in an elongated shape along the left-right direction.

The developer container 12 accommodates therein a developer and is configured to be detachably attached to the image formation unit 10. Upon being mounted on the image formation unit 10, the developer container 12 is attached to the image formation unit main body 11 via the developer supply unit 13.

Figures 3, 4:
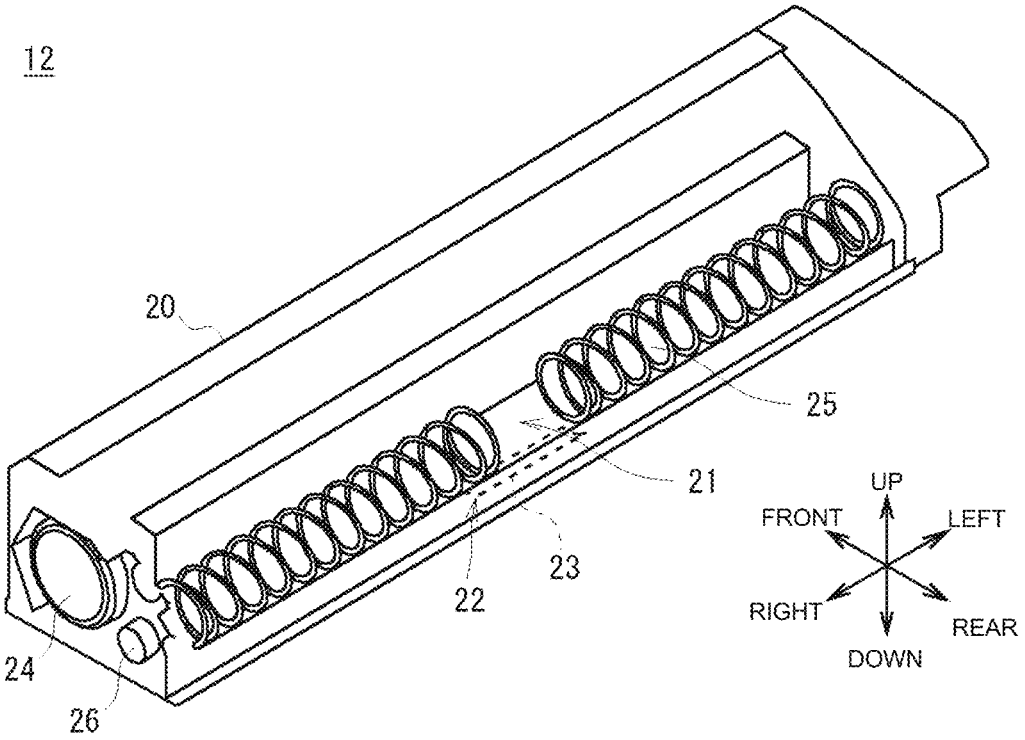
FIG. 3 is a diagram illustrating a configuration of a developer container.
FIG. 4 is a table illustrating results of measurement and evaluation on developers of Examples Da to Dg.

As illustrated in FIG. 3, the developer container 12 includes a container chamber 21 having a cylindrical space elongated in the left-right direction formed inside a container casing 20. The developer is stored in the container chamber 21. The developer container 12 may also be referred to as a toner cartridge.

Provided at a center area in the left-right direction of the bottom of the storage chamber 21 are: a supply hole 22 that is penetrated to connect the space in the storage chamber 21 with the outside of the storage chamber 21; and a shutter 23 to open or close the supply hole 22. The shutter 23 is connected to a lever 24 and opens or closes the supply hole 22 as the lever 24 is rotated. When the developer container 12 is attached to or removed from the image formation unit 10, the lever 24 is operated by the user.

For example, before being mounted on the image formation unit 10 (FIG. 2), the developer container 12 closes the supply hole 22 by the shutter 23 to prevent the developer stored in the container chamber 21 from leaking to the outside thereof. When the developer container 12 is mounted on the image formation unit 10, the lever 24 is rotated in a predetermined opening direction so as to move the shutter 23 to open the supply hole 22. As a result, the developer container 12 connects the space in the container chamber 21 with the space in the developer supply unit 13, and supplies the developer from the container chamber 21 to the image formation main body 11 via the developer supply unit 13. When the developer container 12 is demounted from the image formation unit 10, the lever 24 is rotated in a predetermined closing direction to move the shutter 23 to close the supply hole 22.

An agitation member 25 is also provided inside the container chamber 21. The agitation member 25 is formed in a shape such that an elongated member is spirally circumscribed around a central axis along the left-right direction, and is configured to be rotated about the central axis in the container chamber 21. An agitation driver 26 is provided at an end of the container casing 20. The agitation driver 26 is connected to the agitation member 25. When drive power is supplied from a drive power source provided in the housing 2 (FIG. 1), the agitation driver 26 transmits the drive power to the agitation member 25 to rotate the agitation member 25. In this way, the developer container 12 can agitate the developer contained in the container chamber 21 to prevent aggregation of the developer, and forward the developer to the supply hole 22.

The image formation unit main body 11 (FIG. 2) are formed with an image formation casing 30, a developer storage room 31, a first supply roller 32, a second supply roller 33, a development roller 34, a development blade 35, a photosensitive drum 36, a charging roller 37, and a cleaning blade 38. Among these, each of the first supply roller 32, the second supply roller 33, the developing roller 34, the photosensitive drum 36, and the charging roller 37 is configured in a cylindrical shape with a central axis along the left-right direction, and is rotatably supported by the image formation casing 30.

Note that, in the image formation unit 10S for the special color (S), the developer container 12 containing therein a developer of a special color (white, clear, or silver, etc.) selected in advance by the user is mounted on the image formation unit main body 11 via the developer supply unit 13.

The developer storage room 31 accommodates therein the developer to be supplied from the developer container 12 via the developer supply unit 13. Each of the first supply roller 32 and the second supply roller 33 includes an elastic layer made of conductive urethane rubber foam or the like formed on the circumferential surface thereof. The developing roller 34 includes, at the circumferential surface thereof, an elastic layer, a surface layer having conductivity, and the like. The development blade 35 is made of, for example, a stainless steel plate of a predetermined thickness. A part of the development blade 35 is in contact with the circumferential surface of the development roller 34, in a state where the development blade 35 slightly elastically deformed.

The photosensitive drum 36 includes a thin charge generation layer and a thin charge transport layer sequentially formed on the circumferential surface thereof, and thus is able to be charged. The charging roller 37 includes a conductive elastic member coating the circumferential surface thereof. The circumferential surface of the charging roller 37 is in contact with the circumferential surface of the photosensitive drum 36. The cleaning blade 38 is made of, for example, a thin sheet of resin. A part of the cleaning blade is in contact with the circumferential surface of the photosensitive drum 36 in a state where the cleaning blade 38 is slightly elastically deformed.

The LED head 14 is located above the photosensitive drum 36 of the image formation unit main body 11. The LED head 14 includes a plurality of light-emitting element chips arranged in a straight line along the left-right direction. The LED head 14 emits lights from light-emitting elements in a light-emitting pattern based on an image data signal supplied from the controller 3 (FIG. 1).

The image formation unit main body 11 rotates the first supply roller 32, the second supply roller 33, the developing roller 34, and the charging roller 37 in the direction of the arrow R1 (clockwise in FIG. 2) and rotates the photosensitive drum 36 in the direction of the arrow R2 (counterclockwise in FIG. 2), with a driving force(s) being supplied from a motor(s) (not illustrated). Further, the image formation unit main body 11 applies a predetermined bias voltage to and thus charge each of the first supply roller 32, the second supply roller 33, the development roller 34, the development blade 35, and the charging roller 37.

The first supply roller 32 and the second supply roller 33 thus have the developer in the developer storage room 31 adhered to the charged circumferential surfaces thereof, and the rotations of the first supply roller 32 and the second supply roller 33 have the adhered developer adhered to the circumferential surface of the developer roller 34. The development blade 35 removes excess developer from the circumferential surface of the development roller 34 so as to form a thin layer of the developer on the circumferential surface of the development roller 34, and the rotation of the development roller 34 forwards the thin layer of the developer to bring in contact with the circumferential surface of the photosensitive drum 36.

On the other hand, the charging roller 37 with being charged contacts the photosensitive drum 36, so as to uniformly charge the circumferential surface of the photosensitive drum 36. The LED head 14 sequentially emits lights at predetermined time intervals to expose the photosensitive drum 36 in a light emission pattern based on the image data signal supplied from the controller 3 (FIG. 1). As a result, an electrostatic latent image is formed on the circumferential surface of the photosensitive drum 36 in the vicinity of the upper end of the photosensitive drum 36.

Then, the rotation of the photosensitive drum 36 in the direction of the arrow R2 brings the portion where the electrostatic latent image is formed into contact with the developing roller 34. Thus, the developer is adhered to the electrostatic latent image on the circumferential surface of the photosensitive drum 36, to develop a developer image based on the image data. The rotation of the photosensitive drum 36 further in the direction of the arrow R2 moves the developer image to reach the vicinity of the lower end of the photosensitive drum 36.

An intermediate transfer section 40 is located below the image formation units 10 in the housing 2 (FIG. 1). The intermediate transfer section 40 is provided with a drive roller 41, a driven roller 42, a backup roller 43, an intermediate transfer belt 44, five primary transfer rollers 45, a secondary transfer roller 46, and a reverse bending roller 47. Of these, the drive roller 41, the driven roller 42, the backup roller 43, each of the primary transfer rollers 45, the secondary transfer roller 46, and the reverse bending roller 47 are all formed in a cylindrical shape with a central axis extending along the left-right direction, and are rotatably supported by the housing 2.

The drive roller 41 is disposed on the rear lower side of the image formation unit 10S, and is rotated in the direction of the arrow R1 when drive power is supplied from a belt motor (not illustrated). The driven roller 42 is located on the front lower side of the image formation unit 10K. The upper ends of the drive roller 41 and the driven roller 42 are located at the same height as or slightly lower than the lower ends of the photosensitive drums 36 (FIG. 2) of the image formation units 10. The backup roller 43 is located on the front lower side of the drive roller 41 and on the rear lower side of the driven roller 42.

The intermediate transfer belt 44 is an endless belt composed of a high resistance plastic film and is wound and suspended around the drive roller 41, the driven roller 42, and the backup roller 43. In the intermediate transfer section 40, the five primary transfer rollers 45 are provided below an upper line of the intermediate transfer belt 44 stretched between the drive roller 41 and the driven roller 42, i.e., directly below the five image formation units 10 respectively, in such a manner that the five primary transfer rollers 45 are respectively opposed to the five photosensitive drums 36 of the image formation units 10 across the upper line of the intermediate transfer belt 44. Predetermined bias voltages are applied to the primary transfer rollers 45.

The secondary transfer roller 46 is located directly below the backup roller 43 and is biased toward the backup roller 43. That is, the intermediate transfer section 40 sandwiches the intermediate transfer belt 44 between the secondary transfer roller 46 and the backup roller 43. A predetermined bias voltage is also applied to the secondary transfer roller 46. The secondary transfer roller 46 and the backup roller 43 may be collectively referred to as a secondary transfer part 49.

The reverse bending roller 47 is located at a location near the lower front side of the drive roller 41 and the upper rear side of the backup roller 43, and biases the intermediate transfer belt 44 in the upper front direction. As a result, the intermediate transfer belt 44 is in a state in which tension acts between the rollers without any slack. Also, a reverse bending backup roller 48 is provided on the front upper side of the reverse bending roller 47 and opposed to the reverse bending roller 47 across the intermediate transfer belt 44.

The intermediate transfer section 40 rotates the drive roller 41 in the direction of the arrow R1 by the drive power supplied from the belt motor (not illustrated), which causes the intermediate transfer belt 44 to run in the direction along the arrow E1. Each primary transfer roller 45 also rotates in the direction of the arrow R1 with the predetermined bias voltage being applied. This enables the image formation units 10 to transfer the developer images that have been reached to the lower ends on the circumferential surfaces of the photosensitive drums 36 (FIG. 2) to the intermediate transfer belt 44, to sequentially overlap the developer images of the respective colors on the intermediate transfer belt 44. With this, the developer images of the respective colors are sequentially superimposed on the surface of the intermediate transfer belt 44, starting with the developer image of silver (S) on the most upstream side. The intermediate transfer section 40 runs the intermediate transfer belt 44, which causes the developer image transferred from each of the image formation units 10 to reach the vicinity of the backup roller 43.

By the way, a conveyance path W, which is a path for conveying a paper P, is formed inside the housing 2 (FIG. 1). In the housing 2, the conveyance path W extends from near the front lower end of the housing 2 in a front-upward direction, carves about half a turn, and then extends therefrom in the rear direction beneath the intermediate transfer section 40. The conveyance path W extends therefrom in the upper direction along the back sides of the intermediate transfer section 40 and the image formation unit 10S, and then extends in the front direction. In other words, the conveyance path W is formed in like a capital letter "S" in FIG. 1. Inside the housing 2, various parts are arranged along the conveyance path W.

A first paper feed section 50 is disposed near the lower end in the housing 2 (FIG. 1). The first paper feed section 50 is provided with a paper cassette 51, a pickup roller 52, a feed roller 53, a retard roller 54, a conveyance guide 55, and pairs of conveyance rollers 56, 57, and 58, and the like. Note that the pickup roller 52, the feed roller 53, the retard roller 54, and the conveyance rollers 56, 57, and 58 are all formed in a cylindrical shape with a central axis extending along the left-right direction.

The paper cassette 51 is formed in a rectangular shape having a hollow therein, and the paper cassette 51 stores therein the paper P in a stacked state with the paper surfaces of the paper P facing upward and downward, i.e., in an accumulated state. The paper cassette 51 is detachable from the housing 2.

The pickup roller 52 is in contact with a front end portion of an upper surface of an uppermost sheet of paper P in the paper cassette 51. The feed roller 53 is disposed in front of the pickup roller 52 with a short distance therebetween. The retard roller 54 is located below the feed roller 53 and forms a gap equivalent to the thickness of a sheet of paper P between the feed roller 53 and the retard roller 54.

The first paper feed section 50 stops or rotates the pickup roller 52, the feed roller 53, and the retard roller 54 as appropriate when drive power is supplied from a paper feed motor (not illustrated). Thus, the pickup roller 52 forwards one or more of the uppermost sheets of paper P stored in the paper cassette 51. The feed roller 53 and the retard roller 54 further forward only the uppermost one of the forwarded sheets, by stopping the second and lower sheets of the forwarded sheets. Thus, the first paper feed section 50 feeds the paper P in the front direction while separating the sheets of paper P one by one.

The conveyance guide 55 is disposed at the front lower portion in the transfer path W, and causes the paper P to travel along the path W in the front upper direction and then further in the rear upper direction. The conveyance roller pairs 56 and 57 are disposed near the center and near the upper end of the conveyance guide 55, respectively, and are rotated in predetermined directions when the drive power is supplied from the paper feed motor (not illustrated). The conveyance roller pairs 56 and 57 thereby cause the paper P to move along the conveyance path W.

A second paper feed section 60 is also provided on the front side of the conveyance roller pair 57 in the housing 2. The second paper feed section 60 includes a paper tray 61, a pickup roller 62, a feed roller 63, a retard roller 64, and the like. The paper tray 61 is formed in a thin plate shape having a thickness in the vertical direction, and paper P2 is placed on the upper side of the paper tray 61. Note that, the paper P2, which may be different in size or quality from the paper P stored in the paper cassette 51, for example, is placed on the paper tray 61.

The pickup roller 62, the feed roller 63, and the retard roller 64 are configured in the same manner as or a similar manner to the pickup roller 52, the feed roller 53, and the retard roller 54 of the first paper feed section 50, respectively. When drive power is supplied from a paper feed motor (not illustrated), the second paper feed section 60 rotates or stops the pickup roller 62, the feed roller 63, and the retard roller 64 as appropriate, to feed in the rear direction the uppermost sheet of the paper P2 while stopping the second and lower sheets of the paper P2 on the paper tray 61. Thus, the second paper feed section 60 feeds the paper P2 in the rear direction while separating the sheets of the paper P2 one by one. The fed paper P2 is conveyed along the conveyance path W by the conveyance roller pair 57 in the same manner as the paper P. For convenience of explanation, the paper P2 will be hereinafter referred to simply as the paper P without distinguishing the paper P2 from the paper P.

The rotation of the conveyance roller pair 57 is controlled appropriately to exert a frictional force on the paper P, to correct a so-called skew of the paper P with respect to the conveyance direction of the paper P, that is, to align the leading and trailing ends of the paper P along the left-right direction, and then feed the paper in the rear direction. The conveyance roller pair 58 is located on the rear side of the conveyance roller pair 57 with a predetermined distance therefrom, and is rotated in the same manner as the conveyance roller pair 56 and the like, to supply a driving force to the paper P being conveyed along the conveyance path W to cause the paper P to travel further to the rear side along the conveyance path W.

The secondary transfer part 49 of the intermediate transfer section 40, which includes the backup roller 43 and the secondary transfer roller 46, is disposed on the rear side of the transfer roller pair 58. While the predetermined bias voltage is applied to the secondary transfer roller 46 of the secondary transfer part 49, the developer images that are formed by the image formation units 10 and transferred to the intermediate transfer belt 44 are moved toward the secondary transfer part 49 as the intermediate transfer belt 44 runs. Therefore, the secondary transfer part 49 transfers the developer images from the intermediate transfer belt 44 to the paper P being conveyed along the conveyance path W and further conveys the paper P that has the developer images transferred thereon in the rear direction.

A fixation unit 70 is located on the rear side of the secondary transfer part 49. The fixation unit 70 includes a heating part 71 and a pressure part 72 disposed opposite to each other across the conveyance path W. The heating part 71 includes a heating belt formed of an endless belt, a plurality of rollers, a heater that generate heat, and the like inside the heating belt. The pressure part 72 is formed in a cylindrical shape with a central axis extending along the left-right direction. The upper surface of the pressure part 72 is pressed against the lower surface of the heating part 71, so as to form a nip portion therebetween.

Based on the control of the controller 3, the fixation unit 70 heat the heater of the heating part 71 to a predetermined temperature and rotates the rollers of the heating part 71 appropriately to cause the heating belt to travel so as to rotate the heating belt in the direction of arrow R1 and rotate the pressure part 72 in the direction of arrow R2. The fixation unit 70 receives the paper P on which the developer image has been transferred by the secondary transfer section 49, sandwiches (i.e., nips) the paper P between the heating part 71 and the pressure part 72, fixes the developer image on the paper P by applying heat and pressure, and then conveys the paper in the rear direction.

A conveyance roller pair 74 is disposed on the rear side of the fixation unit 70, and a switching part 75 is disposed on the rear side of the conveyance roller pair 74. The switching part 75 switches the direction of travel of the paper P to the upper side or the lower side according to the control of the controller 3. A paper discharge section 80 is provided on the upper side of the switching part 75. The paper discharge section 80 includes a conveyance guide 81 which guides the paper P upwardly along the conveyance path W, and conveyance roller pairs 82, 83, 84, and 85 which face each other across the conveyance path W, and the like.

A reconveyance section 90 is provided below the switching part 75, the fixation unit 70, and the secondary transfer section 49. The reconveyance section 90 includes a conveyance guide, a conveyance roller pair (not illustrated), and the like which form a reconveyance path U. The reconveyance path U extends in the lower direction from the lower side of the switching part 75, extends therefrom in the front direction, and then joins the conveyance route W at the downstream side of the conveyance roller pair 57 in the conveyance path W.

When discharging the paper P, the controller 3 controls the switching part 75 to switch the direction of travel of the paper P to the upper side, that is, to the paper discharge section 80 side. The paper discharge section 80 conveys the paper P received from the switching part 75 upwardly and discharges the paper P from a discharge port 86 to a paper discharge tray 2T. When re-conveying the paper P, the controller 3 controls the switching part 75 to switch the direction of travel of the paper P to the lower side, that is, to the reconveyance section 90 side. The reconveyance section 90 conveys the paper P received from the switching part 75 along the reconveyance path U, and eventually causes the paper P to reach the downstream side of the conveyance roller pair 57 in the conveyance path W to be conveyed again along the conveyance path W. This allows the image formation apparatus 1 to perform so-called double-sided printing because the paper P is returned to the conveyance path W with the surfaces of the paper P being upside down.

In this way, the image formation apparatus 1 forms the developer images by the image formation units 10, transfers the developer images to the intermediate transfer belt 44, transfers the developer images from the intermediate transfer belt 44 to the paper P by the secondary transfer part 49, and fixes the developer images to the paper P by the fixation unit 70, thereby printing the image on the paper P (i.e., forming the image on the paper).

2. Method of Manufacturing Developer

Next, manufacturing of the developer to be contained in the developer container 12 of the image formation unit 10 (FIG. 2) is described. A method of manufacturing of a silver (silver color) developer is particularly described in this embodiment.

In general, a developer includes, in addition to a pigment for expressing a desired color, a binder resin for binding the pigment to a medium such as paper P, external additives for improving the chargeability, and the like. For convenience of explanation, a particle containing a pigment and a binder resin or a powdery substance in which these particles are aggregated is hereinafter referred to as a toner or toner particle, and a powdery substance containing external additives or the like in addition to the toner is referred to as a developer D.

In the following, a plurality of types of the developers D having different configurations and characteristics from each other are manufactured, by appropriately differing the conditions at the time of manufacture and the like. In the following, the developers D manufactured by Example 1, Example 2, Example 3, Example 4, Example 5, Example 6, and Example 7 are referred to as developers Da, Db, Dc, Dd, De, Df, and Dg, respectively. Specifically, the developers Da, Db, Dc, Dd, De, Df, and Dg are obtained by using three levels of metallic pigments whose pigment volume median diameters are 5.37 μm, 5.80 μm, and 8.69 μm, and finely adjusting the resin viscosities and the classification conditions thereof. A method of measuring the volume median diameter of the developer and the lustrous pigment is described below in detail. Note that a "volume median diameter" of a mass of particles refers to a mean size, where half of the volume of the particles in the mass are smaller, and half of the volume of the particles in the mass are larger than the mean size. That is, when a cumulative curve is calculated in a particle size distribution of the particles with the total volume of the particles as 100%, the particle diameter at the point where the cumulative curve is 50% is defined as a volume median diameter (Dv50, 50%). A "volume median diameter of effective components" is the particle diameter at the point where a cumulative curve is 50%, when the cumulative curve is calculated in a particle size distribution of a part of the particles with small diameter particles are removed with the total volume of the part of the particles with small diameter particles are removed as 100%.

2-1. Example 1

In Example 1, first, an aqueous medium in which an inorganic dispersant is dispersed is produced. Specifically, 920 parts by weight of industrial trisodium phosphate dodecahydrate are mixed with 2700 parts by weight of pure water and dissolved at a liquid temperature of 60° C., and then dilute nitric acid for pH (hydrogen ion index) adjustment is added, to thus obtain the aqueous solution. To this aqueous solution, a calcium chloride solution, in which 440 parts by weight of industrial calcium chloride anhydride are dissolved in 4,500 parts by weight of pure water, is added, and then the solution is stirred at high speed by a line mill (from Primix Corporation) at a rotation speed of 3,566 rpm (rotation per minute) for 34 minutes while maintaining the liquid temperature at 60° C. In this way, the aqueous phase is adjusted, which is the aqueous medium in which the suspension stabilizer (inorganic dispersant) is dispersed.

In Example 1, in the process of adjusting a resin solution, a pigment-dispersed oily medium is produced. Specifically, 395 parts by weight of a lustrous pigment (having the volume median diameter of 8.69 μm) and 60 parts by weight of a charge controller (BONTRON E-84: manufactured by Orient Chemical Industry Co.) are mixed to 7430 parts by weight of ethyl acetate serving as an organic solvent, to produce a pigment dispersion solution. Among them, the lustrous pigment contains tiny flakes of aluminum (Al), i.e., minute flakes each formed in a flat shape, a flattened shape, and/or a scaly shape. In the following, the lustrous pigment may be also referred to as an aluminum pigment, a metallic pigment or a silver toner pigment. In this case, the average particle diameter of the lustrous pigment (also referred to as volume median diameter, average median diameter, or pigment volume median diameter) is preferably 5 μm or more and 20 μm or less. The reasons are explained below.

First, because it is known that if the volume median diameter of the lustrous pigment is less than 5 μm, the lustrousness of the developer is reduced by that amount, and the lustrousness of the image is also reduced, resulting in lower image quality. Second, it is known that if the volume median diameter of the lustrous pigment is larger than 20 μm, it is difficult to encapsulate the lustrous pigment in the toner base particles (may be referred to as toner matrix particles or toner mother particles) and thus it becomes difficult to form a developer, and even if the developer is formed, it is difficult to transport the developer in the image formation apparatus 1 and thus an image may be unable to be formed.

After that, while the pigment dispersion solution is stirred as maintaining the liquid temperature at 60° C. (degree Celsius), 60 parts by weight of a charge control resin (FCA-726N: manufactured by Fujikura Kasei Co., Ltd.), 150 parts by weight of an ester wax (WE-4: manufactured by Nichiyu Corporation) as a release agent, and 1,310 parts by weight of a polyester resin as a binder resin (binding resin) are added to the pigment dispersion solution, and the pigment dispersion solution keeps to be stirred until no solids are left. This thereby produces an oil phase, which is a pigment-dispersed oily medium.

Next, the oil phase is added into the aqueous phase in which the liquid temperature is maintained at 60° C., and is suspended by stirring at a rotational speed of 900 rpm for 5 minutes, to form particles in the suspension. Next, the suspension is distilled under reduced pressure to remove the ethyl acetate and form a slurry containing the developer. Next, nitric acid is added to the slurry to reduce the pH (hydrogen ion index) to 1.6 or less, and the slurry is stirred to dissolve tricalcium phosphate as a suspension stabilizer, and then dehydrated to form the developer. Then, the dehydrated developer is dispersed and stirred in pure water, to wash the developer. Thereafter, a dehydration process, a drying process and a classification process are carried out to produce toner base particles.

Next, as an external additive addition process, 1.5 [weight %] of small silica (RY200: manufactured by NIPPON AEROSIL Co., Ltd.), 2.29 [weight %] of colloidal silica (X24-9163A: manufactured by Shin-Etsu Chemical Co., Ltd.), and melamine particles (EPOSTAR S: manufactured NIPPON SHOKUBAI Co., Ltd.) are added to the produced toner base particles and mixed to obtain the developer Da.

In this way, in Example 1, the developer Da whose developer volume median diameter is 16.52 μm is obtained by generating toner base particles with the pigment volume median diameter (the volume median diameter of the pigment) of 8.69 μm and adding external additives to the toner base particles.

2-2. Example 2

In Example 2, the developer Db whose volume median diameter (the volume median diameter of the developer Db) is 16.16 μm is obtained by generating toner base particles with the volume median diameter of the pigment of 8.69 μm and adding external additives to the toner base particles in the same process as in Example 1.

2-3. Example 3

In Example 2, the developer Dc whose volume median diameter (the volume median diameter of the developer Dc) is 14.26 μm is obtained by generating toner base particles with the volume median diameter of the pigment of 8.69 μm and adding external additives to the toner base particles in the same process as in Example 1.

2-4. Example 4

In Example 4, the developer Dd whose volume median diameter (the volume median diameter of the developer Dd) is 12.76 μm is obtained by generating toner base particles with the volume median diameter of the pigment of 5.80 μm and adding external additives to the toner base particles in the same process as in Example 1.

2-5. Example 5

In Example 5, the developer De whose volume median diameter (the volume median diameter of the developer De) is 16.15 μm is obtained by generating toner base particles with the volume median diameter of the pigment of 5.37 μm and adding external additives to the toner base particles in the same process as in Example 1.

2-6. Example 6

In Example 6, the developer Df whose volume median diameter (the volume median diameter of the developer Df) is 15.70 μm is obtained by generating toner base particles with the volume median diameter of the pigment of 5.37 μm and adding external additives to the toner base particles in the same process as in Example 1.

2-7. Example 7

In Example 7, the developer Dg whose volume median diameter (the volume median diameter of the developer Dg) is 8.40 μm is obtained by generating toner base particles with the volume median diameter of the pigment of 5.37 μm and adding external additives to the toner base particles in the same process as in Example 1.

3. Measurement and Comparison on Developers

Next, measurement and evaluation on the developers D (i.e., the developers Da, Db, Dc, Dd, De, Df and Dg, hereinafter may be collectively referred to as developers Da to Dg) are described. Regarding the measurement on the developer D, the developer volume median diameter (the volume median diameter (Dv50) of the developer) and the pigment volume median diameter (the volume median diameter (Dv50) of the luminous pigment) are measured, respectively.

3-1. Measurement of Developer Volume Median Diameter and Pigment Volume Median Diameter In this measurement, the volume median diameter of the developer D and the volume median diameter of the lustrous pigment in the developer are measured by using a precision particle size analyzer (Multisizer 3: manufactured by Beckman Coulter Co., Ltd.). The measurement conditions are as follows.

Aperture diameter: 100 μm,

Electrolyte solution: ISTON II (manufactured by Beckman Coulter Co., Ltd.), and

Dispersion solution: Neogen S-20F (manufactured by Daiichi Kogyo Seiyaku Co., Ltd.) is dissolved in the aforementioned electrolyte and adjusted to a concentration of 5%

In this measurement, 10 to 20 [mg] of the measurement sample is added to 5 [mL] of the aforementioned dispersion solution and dispersed for 1 minute using an ultrasonic disperser, and then 25 [mL] of electrolyte solution is added and dispersed for 5 minutes using an ultrasonic disperser to remove agglomerates through a mesh with a mesh opening of 75 μm to prepare a sample dispersion solution.

Furthermore, in this measurement, the sample dispersion solution is added to 100 [mL] of the aforementioned electrolytic solution, and 30,000 particles therein are measured by the aforementioned precision particle size analyzer to obtain the distribution (i.e., volume particle size distribution). Then, in this measurement, the developer volume median diameter (Dv50) and the pigment volume median diameter (Dv50) are determined based on this volume particle size distribution, respectively.

Note that a volume median diameter (Dv50) of a sample refers to a certain particle diameter, in the particle diameter distribution, where the number or mass of particles larger than the certain particle diameter accounts for 50% of the total number or mass of all the particles of the sample. The aforementioned precision particle size analyzer measures the particle size distribution using the Coulter principle. The Coulter principle, called the pore electrical resistance method, is a method for measuring the volume of particles by applying a constant electric current through pores (apertures) in an electrolyte solution and measuring the change in an electrical resistance of the pores as the particles pass through them.

By this measurement, the measurement results as illustrated in the table in FIG. 4 are obtained as the developer volume median diameter and the pigment volume median diameter of each developer D (i.e., developers Da to Dg).

4. Measurement and Comparison on Removal Processed Toner

Next, measurement and evaluation on a residue of the developers D (i.e., developers Da to Dg) that is dissolved in tetrahydrofuran (THF) are described. That is, after obtaining each of the developers D of Examples 1 to 7, the size of the metallic pigment particles contained in the developer is measured by the following method. Regarding the measurement on the developer D, the volume median diameter (Dv50) of an extracted metallic pigment, which corresponds to the volume median diameter of the pigment in the developer, is measured.

4-1. Process of Removing External Additives

In this measurement, the external additives are removed from each developer D (i.e., developers Da to Dg) to obtain the toner base (the toner base particles) by a removal process described below, and then the lustrous pigment contained in the toner base particles is extracted from the toner base particles.

In this removal process, first, pure water is added to a nonionic surfactant, and then the water is heated and stirred to disperse the nonionic surfactant in the pure water. The non-ionic surfactant is, for example, a polyoxyethylene alkyl ether, or the like. This results in a surfactant aqueous solution. Note that the conditions such as the heating temperature and the stirring time can be set arbitrarily. As a surfactant, EMULGEN 5% aqueous solution manufactured by Kao Corporation may be used for example.

Next, in the removal process, 100 ml (=$cm^3$) of the surfactant aqueous solution is added into a beaker in which 2 grams of one of the developers Da to Dg (unprocessed developers) is contained, and then the liquid in the beaker is stirred for 40 minutes while maintaining the liquid temperature of the surfactant aqueous solution at 25° C. Next, in the removal process, the beaker is placed in a water bath, and then the water bath (temperature: 38° C.) is vibrated using an ultrasonic vibrator for 40 minutes.

Next, in the removal process, a residue is collected by suction filtration of the surfactant aqueous solution. Then, in the removal process, the residue is washed thoroughly and then dried. In this way, the external additives are removed from each of the developers Da to Dg, so as to obtain the removal processed toners D1*a*, D1*b*, D1*c*, D1*d*, D1*e*, D1*f* and D1*g*. Hereinafter, the removal processed toners D1*a* to D1*g* may be referred to as removal treated toner D1.

Finally, in order to confirm whether the external additives have been sufficiently removed in the removal processed toners D1*a* to D1*g*, the content rate of a specific element contained in the removal processed toners D1*a* to D1*g* is measured using any one or more of elemental analysis devices. In a case where silica is used as the external additives, for example, the specific element is silicon (Si). Therefore, in the removal process, the content rate of silicon remaining in each of the removal processed toners D1*a* to D1*g* is measured using an energy dispersive X-ray fluorescence analyzer (EDX-800HS, manufactured by Shimadzu Corporation).

In general, when a sample is irradiated with X-rays, fluorescent X-rays, which are X-rays specific to the atoms contained in the sample, are produced and emitted from the sample. Since the X-ray fluorescence has a wavelength (energy) specific to each element, qualitative analysis can be performed by examining the wavelength of the X-ray fluorescence. The intensity of the X-ray fluorescence is a function of the concentration. Therefore, the quantitative analysis can be performed by measuring the X-ray dose at each element-specific wavelength.

Based on such a principle, using the energy dispersive X-ray fluorescence analyzer described above, X-rays emitted from an X-ray tube are irradiated to each of the removal processed toners D1*a* to D1*g*, and the content amount of the silicon (Si) in each of the removal processed toners D1*a* to D1*g* is measured based on the fluorescent X-rays emitted from the atoms of the silicon (Si) contained in the removal processed toners D1*a* to D1*g*. Note that the operating conditions of the energy dispersive X-ray fluorescence analyzer are set as follows.

Atmosphere: Helium substitution measurement, and X-ray tube voltage: voltage 15 [kV], voltage 50 [kV].

Based on the measurement results of the content rate of the specific element in the removal processed toner D1 (D1*a* to D1*g*), if a difference between the content rate of the specific element of the removal processed toner and that of the toner before the external additives are added is 0.21% or less, it is determined that approximately all of the external additives has been removed in the removal processed toner D1. If the difference in the content rate of the specific element is greater than 0.21%, the external additive removal process is considered to be insufficient. Thus, the external additive removal process described above is repeated until the difference in the content rate of the specific element is less than 0.21%.

4-2. Method of Extracting Lustrous Pigment

Next, the removal processed developer D1 (D1*a* to D1*g*), from which the external additives have been removed, is subjected to a pigment extraction process described below, to remove non-pigments such as the binder resin, wax and the like, so as to extract the lustrous pigment.

In the pigment extraction process, first, 100 grams of tetrahydrofuran is added to a beaker in which 1 gram of the removal processed developer D1 is contained, and then the liquid in the beaker is stirred for 60 minutes at a rotational speed of 340 rpm (rotations per minute) while maintaining the liquid temperature at 60° C. Next, in the pigment extraction process, a residue is collected by suction filtration of the tetrahydrofuran.

Next, in the pigment extraction process, the residue is placed in a beaker, 100 grams of tetrahydrofuran is added to the beaker, and the liquid in the beaker is stirred at a rotational speed of 340 rpm for 90 minutes while maintaining the liquid temperature at 60° C. Next, in the pigment extraction process, a residue is collected by suction filtration of the tetrahydrofuran.

Next, in the pigment extraction process, the residue is placed in a beaker, 100 grams of tetrahydrofuran is added to the beaker, and the liquid in the beaker is stirred at a rotational speed of 340 rpm for 180 minutes while maintaining the liquid temperature at 60° C. Next, in the pigment extraction process, a residue is collected by suction filtration of the tetrahydrofuran.

Next, in the pigment extraction process, the residue is placed in a beaker, 100 grams of tetrahydrofuran is added to the beaker, and the liquid in the beaker is stirred at a rotational speed of 340 rpm for 240 minutes while maintaining the liquid temperature at 60° C. Next, in the pigment extraction process, a residue is collected by suction filtration of the tetrahydrofuran.

Next, in the pigment extraction process, the residue is placed in a beaker, 100 grams of tetrahydrofuran is added to the beaker, and the liquid in the beaker is stirred at a rotational speed of 340 rpm for 180 minutes while maintaining the liquid temperature at 60° C. Next, in the pigment extraction process, a residue (metallic pigment) is collected by suction filtration of the tetrahydrofuran.

4-3. Measurement of Volume Median Diameter of Pigment in Developer

The residue (metallic pigment) extracted by the method described above is measured using a precision particle size analyzer Multisizer 3 (manufactured by Beckman Coulter Co., Ltd.) in the same manner as the measurement of the volume median diameter of the developer and the volume median diameter of the pigment in the developer described above. By this measurement, the volume median diameter of the residue (the metallic pigment) extracted from each of the developers D (i.e., developers Da to Dg) is obtained. The measurement results are illustrated in the table in FIG. 5.

5. Calculation of Volume Median Diameter of Developer Effective Components

Here, the particle sizes of the metallic pigment to be used for the lustrous developer are very large and may be more than 100 times larger, in the volume median diameter basis, than pigments to be used in ordinary color developers. Since the volume median diameter of the metallic pigment is also close to the volume median diameter of the lustrous developer, the lustrous developer includes toner particles whose sizes are less than the volume median diameter of the metallic pigment in the volume particle size distribution of the lustrous developer. In other words, the lustrous developer has a major characteristic that it contains two parts: a transparent toner portion which does not contain the metallic pigment and a lustrous portion which contains the metallic pigment.

An embodiment of the disclosure may be to solve a problem of a so-called transfer dropout, in which a portion of the developer that contains the metallic pigment in the developer (the lustrous portion) cannot be properly transferred during the transfer process. Accordingly, to solve the problem, the lustrous portion is mainly considered. There may be multiple methods for separating the components of the developer into the lustrous portion and the transparent toner portion. In this disclosure, the components of the developer are separated into the lustrous portion and the transparent toner portion based on the volume median diameter. That is, in this disclosure, a part of particles of the developer whose particle sizes are less than the measure volume median diameter of the pigment in the developer is considered to be the transparent toner portion.

The idea is that the particles having the sizes less than the volume median diameter of the lustrous pigment in the developer are likely to contain no lustrous pigment. Note that, strictly speaking, since the lustrous pigment has a volume particle size distribution, there is a possibility that particles having the sizes less than the volume median diameter of the lustrous pigment in the developer may contain smaller-size lustrous pigment particles. However, such smaller-size lustrous pigment particles have a low impact on the lustrousness of the image, and thus are ignored in consideration.

Figure 9:
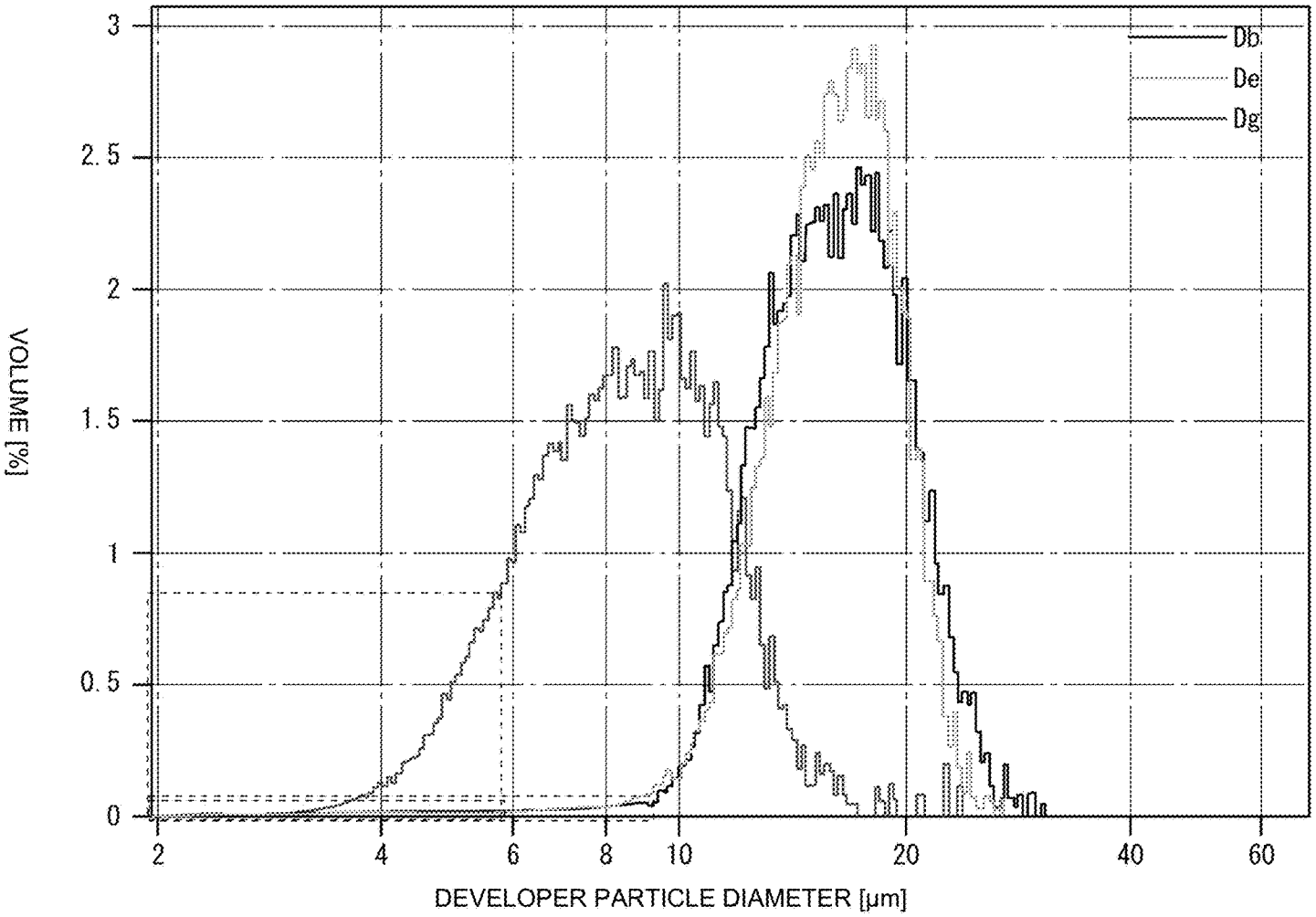
FIG. 9 is a graph illustrating a method (1) of calculating a volume median diameter of effective components in a developer.

As a specific measurement procedure, first, in this measurement, a precision particle size distribution measuring apparatus (Multisizer 3: manufactured by Beckman Coulter Co., Ltd.) is used to measure a volume median diameter of all particles of the developer D in the same manner as the measurement of the developer volume median diameter described above and obtain a volume particle size distribution illustrated in FIG. 9. FIG. 9 illustrates the volume particle size distribution of each of (i) the developer Db, of which the print image quality is judged to be poor in light of the transfer dropout phenomenon, (ii) the developer De, of which the pigment volume median diameter (the volume median diameter of the pigment in the developer De) smaller than that in the developer Db and the print image quality is judged to be poor in light of the transfer dropout phenomenon, and (ii) the developer Dg, of which the pigment volume median diameter and the developer volume median diameter are smaller than those in the developer Db and the print image quality is judged to be good in light of the transfer dropout phenomenon.

Next, in this measurement, from the data of the volume particle size distribution of the developer D (Db, De, Dg) illustrated in FIG. 9, the data of the portion (particles) of the developer whose particle sizes are less than the volume median diameter of the pigment in the developer (i.e., the volume median diameter of the extracted lustrous pigment extracted by dissolving the lustrous developer, which is calculated in the measurement of the volume median diameter of the pigment in the developer described above), is removed as illustrated in FIG. 10.

Figure 10:
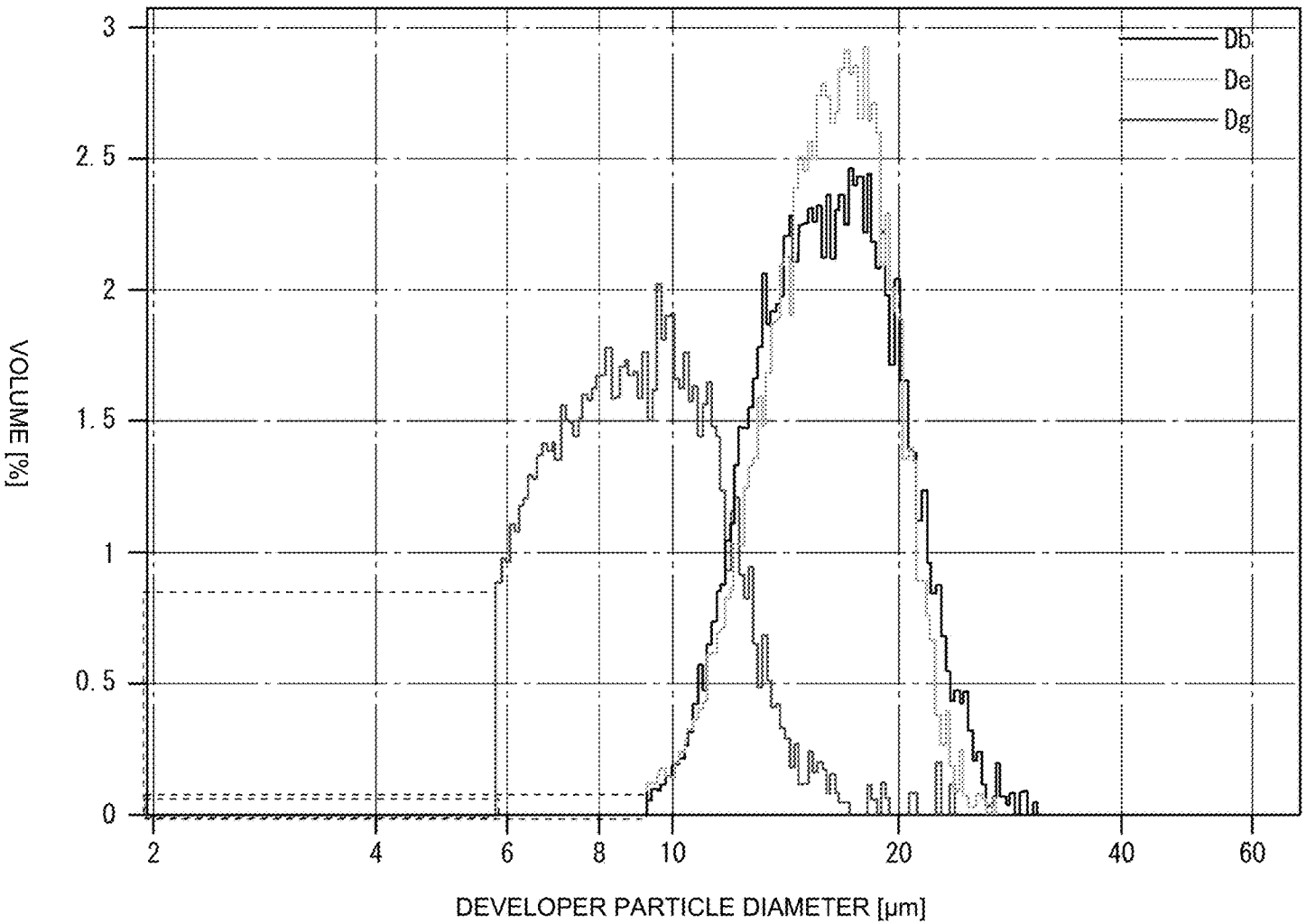
FIG. 10 is a graph illustrating a method (2) of calculating the volume median diameter of the effective components in the developer.

Next, based on a portion of the volume particle size distribution that is remained after the data removal as illustrated in FIG. 10, the volume median diameter of the effective components of the developer is calculated. Thus, the calculated volume median diameter of the developer effective components in this measurement is the volume median diameter of only the portion of the lustrous developer that is considered to contain the metallic pigment. In this disclosure, a case where the transparent portion of the developer has a special volume particle size distribution is not considered. Specifically, this is the case where the developer contains many transparent developer components. Because it is presumed that the behavior of the transparent developer components changes more significantly than the characteristics of the lustrous developer components and deviates from the trend obtained in Examples described below. Specifically, in one or more embodiments in the disclosure, the ratio of the components containing the metallic pigment in the developer is in the range of 90.297% to 99.314% or less, as shown in the ratio of the particles whose particle sizes are not less than the pigment volume median diameter in the developer as illustrated in FIG. 5. Thus, the ratio of the remaining portion after subtracting the fine particles (small diameter particles) from the entire lustrous developer with respect to the entire lustrous developer, that is, the ratio of the volume of the particles other than the fines particles contained in the lustrous developer to the volume of the entire lustrous developer, serving as the ratio of the volume of the particles whose particle sizes are not less than the volume median diameter of the pigment in the developer to the volume of the entire lustrous developer, is 90.297% or more and 99.314% or less.

6. Judgement on Transfer Dropout

In this judgment on the transfer dropout, the image formation apparatus 1 (C941dn: manufactured by Oki Data Corporation) such as being illustrated in FIG. 1 performs printing under a special color white mode for a silver developer, in the state where the developer D (one of the developers Da to Dg) is stored in the developer container 12 (see FIG. 2) of the special color image formation unit 10S. Then, the print image of each of the developers Da to Dg is judged with respect to the transfer dropout. The transfer dropout is evaluated by visual judgment of the printed image. In this judgment, the printing operation is carried out in a state where the yellow, magenta, cyan and black image formation units 10 (10K, 10C, 10M, 10Y) other than the special color formation image formation unit 10S are separated away from the intermediate transfer belt 44, in order to eliminate the effects of reverse transfer.

Specifically, in this judgment, the developing bias voltage is adjusted to have a visual reflectance difference of 25 ($\Delta Y=25$), and the fusing temperature at the time of printing is set 180° C., and an alphabet capital letter "T" in a font size of 8 [pt] of each of the developers Da to Dg is printed on a coated paper (OS coated paper W127/m$^2$: manufactured by Fuji Xerox Co., Ltd.) as the paper P by the image formation apparatus 1. At this time, the alphabet capital letter "T" in the font size of 8 [pt] is printed at each of five locations, namely, the upper left, upper right, center, lower left and lower right, on the A4 size paper P. In this judgment, the images are printed with the visual reflectance differences $\Delta Y$ aligned. The visual reflectance Y is an index of brightness. The visual reflectance difference $\Delta Y$ is a difference between the visual reflectance Y of a blank paper state and the visual reflectance Y of a printed image. In this evaluation, the visual reflectance difference $\Delta Y$ is measured by a spectrophotometer (CM-2600d, measuring instrument $\varphi$=8 [mm]: manufactured by Konica Minolta, Inc.)

In this Judgment, the alphabet letter "T" in the font size of 8 [pt] is visually observed using an optical microscope at a magnification of 20 times. In this judgment, a larger total area of a portion in which the developer has dropped out from the letter "T" is judged to be a lower transfer dropout level, whereas a smaller total area of a portion in which the developer has dropped out from the letter "T" is judged to be a higher dropout level. A case in which no transfer dropout has been occurred is judged to be Level 10 in the transfer dropout level. FIG. 5 illustrates the judgment results of the transfer dropout level obtained by averaging the transfer dropout levels of the letters "T" at the five locations on the A4 paper P. Then, in this judgment, the image quality based on the transfer dropout is judged by two-grade evaluation having good and poor. The obtained judgment results are illustrated in FIG. 5. Specifically, in the judgment results, when the transfer dropout level is 7 or higher, the image quality of the developer is judged as good and thus marked with GOOD in FIG. 5, whereas when the transfer dropout level is less than 7, the image quality of the developer is judged as poor and thus marked with POOR in FIG. 5. Actual printed images are illustrated in FIGS. 6A to 6C. FIG. 6A illustrates the printing result (the printed image) using the developer Db in which the transfer dropout has occurred, FIG. 6B illustrates the printing result (the printed image) using the developer De in which the transfer dropout has occurred, and FIG. 6C illustrates the printing result (the printed image) using the developer Dg in which the transfer dropout has barely occurred.

Figure 7:
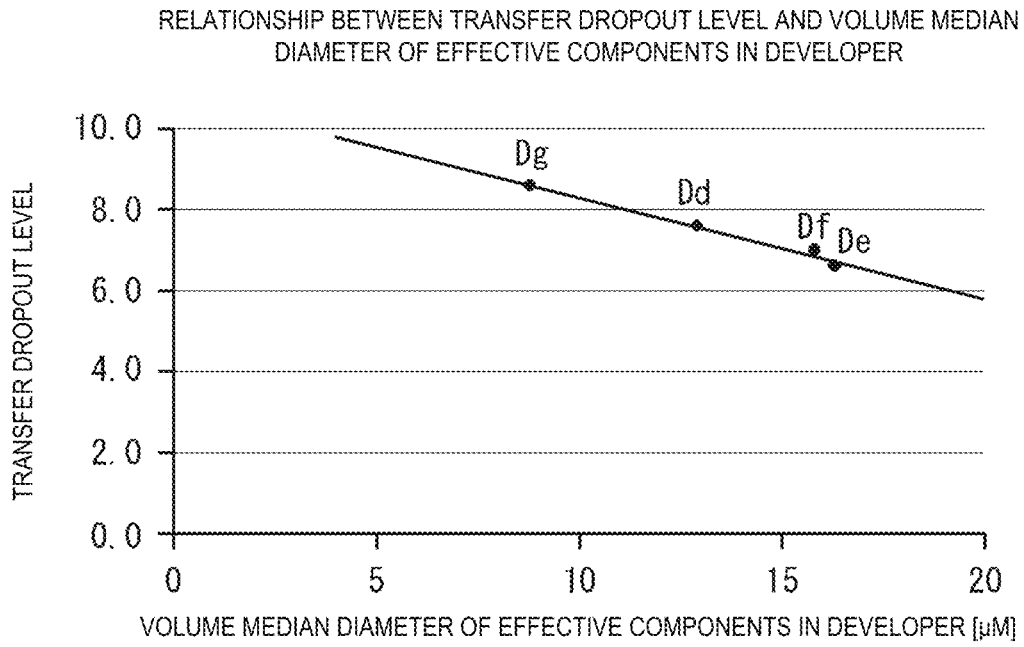
FIG. 7 is a graph illustrating a relationship between a volume median diameter of effective components in the developer and the transfer dropout level.
Figure 8:
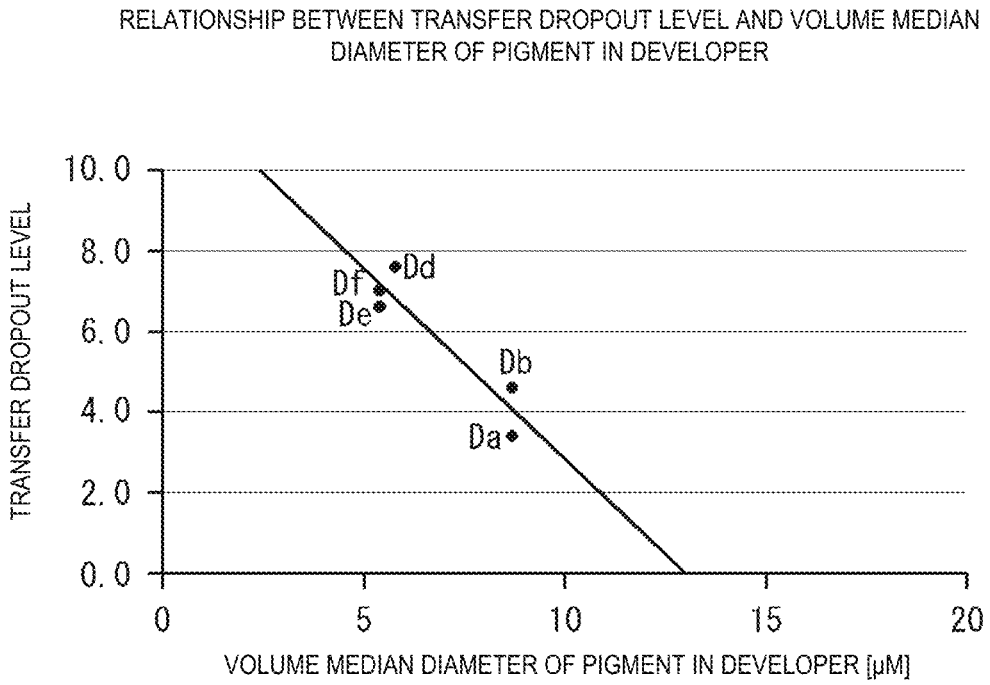
FIG. 8 is a graph illustrating a relationship between the transfer dropout level and a volume median diameter of the pigment in the developer.

7. Determination of Volume Median Diameter of Lustrous Pigment in Developer and Volume Median Diameter of Effective Components in Developer Based on Measurements and Evaluations Next, based on the results of the various measurements and evaluations (FIGS. 4 and 5), the conditions of the volume median diameter of the pigment in the developer D and the volume median diameter of the effective components in the developer D are determined. The relationship between the volume median diameter of the developer effective components and the transfer dropout level obtained by the above-described evaluations is illustrated in FIG. 7. The relationship between the volume median diameter of the pigment in the developer and the transfer dropout level is illustrated in FIG. 8. In FIG. 7, the developers with the pigment volume median diameters of 5.80 μm and 5.37 μm are considered whereas the developers (i.e., developers Da, Db and Dc) with the pigment volume median diameter of 8.69 μm are excluded. In addition, in FIG. 8, the developers whose developer volume median diameter are about 16 μm are considered, whereas the developer (i.e., the value of the developer Dg) whose developer volume median diameter is far from 16 μm is excluded. As illustrated in FIGS. 7 and 8, it can be seen that the transfer dropout level is correlated to both the volume median diameter of the developer effective components and the volume median diameter of the pigment in the developer.

As illustrated in FIG. 7, when the volume median diameter of the pigment in the developer is almost the same, the transfer dropout level increases in FIG. 7 (that is, the transfer dropout is reduced, and the print image quality improves) as the volume median diameter of the developer effective components becomes smaller. It is presumed that this is because, as the developer particles become smaller, mechanical entrapment of the developer particles when the transfer dropout occurs becomes smaller, and the charge retention capacity is improved due to the increased surface area of the developer. In the developers of Examples, the volume median diameter of the developer effective components of 15.81 μm is the maximum volume median diameter at which the image quality based on the transfer dropout is judged as good. Any developers having the volume median diameter of the developer effective components larger than 15.81 μm is judged as poor in the image quality based on the transfer dropout. In addition, an attempt is made to make the volume median diameter of the developer effective component as small as possible by adjusting the manufacturing conditions of the developer and adjusting the binder resin, and the like. However, when the metallic pigment whose volume median diameter is 5.44 μm (which is the smallest volume median diameter of the pigment in the developer) is used to manufacture, it is found that the metallic pigment particle is projected from the binder resin particle so as not to form an appropriate developer particle shape, when the volume median diameter of the developer effective components is less than 8.81 μm. Therefore, it can be seen that the maximum value and the minimum value of the volume median diameter of the effective components of the developer are 15.81 μm and 8.81 μm, respectively.

As illustrated in FIG. 8, when the developer volume median diameters are almost the same as each other, the transfer dropout level increases (that is, the transfer dropout is reduced, and the print image quality improves) as the volume median diameter of the pigment in the developer decreases. This is presumably due to that as the volume median diameter of the pigment in the developer becomes smaller, the electrical resistance of the entire developer is stabilized and thus the unevenness in the transfer process is reduced. In the developers of Examples, the volume median diameter of the pigment in the developer of 5.91 μm is the maximum volume median diameter at which the print image quality based on the transfer dropout is judged as good. Any developer having a volume median diameter of the pigment in the developer larger than 5.91 μm is judged as poor in the print image quality based on the transfer dropout. In addition, an attempt is made to micrify the metallic pigment to be used at the time of manufacture in order to make the volume median diameter of the pigment in the produced developer as small as possible, and it is found that it may be impossible to make the volume median diameter of the pigment in the produced developer smaller than 5.44 μm (the volume median diameter of the metallic pigment to be used at the time of manufacture smaller than 5.37 μm). Therefore, it is found that the volume median diameter of the pigment in the developer may be 5.91 μm at the maximum and 5.44 μm at the minimum.

Specifically, the developer Da of Example 1, the developer Db of Example 2, the developer Dc of Example 3, and the developer Dd of Example 5, which are judged as poor in the transfer dropout judgement, are excluded. The developers Dd, Df, and Dg of Examples 4, 6, and 7, which are judged to be good in the transfer dropout judgment, are adopted to be used for printing in an embodiment.

8. Effects and Etc

With the above configuration, the image formation apparatus 1 (FIG. 1) according to an embodiment that stores the lustrous silver color developer D in the developer container 12 (FIG. 2) of the image formation unit 10S can express the lustrous silver color in the image printed on the paper P. In an embodiment, the developer D is produced using the lustrous pigment containing the minute flakes of aluminum (Al).

Figure 11:
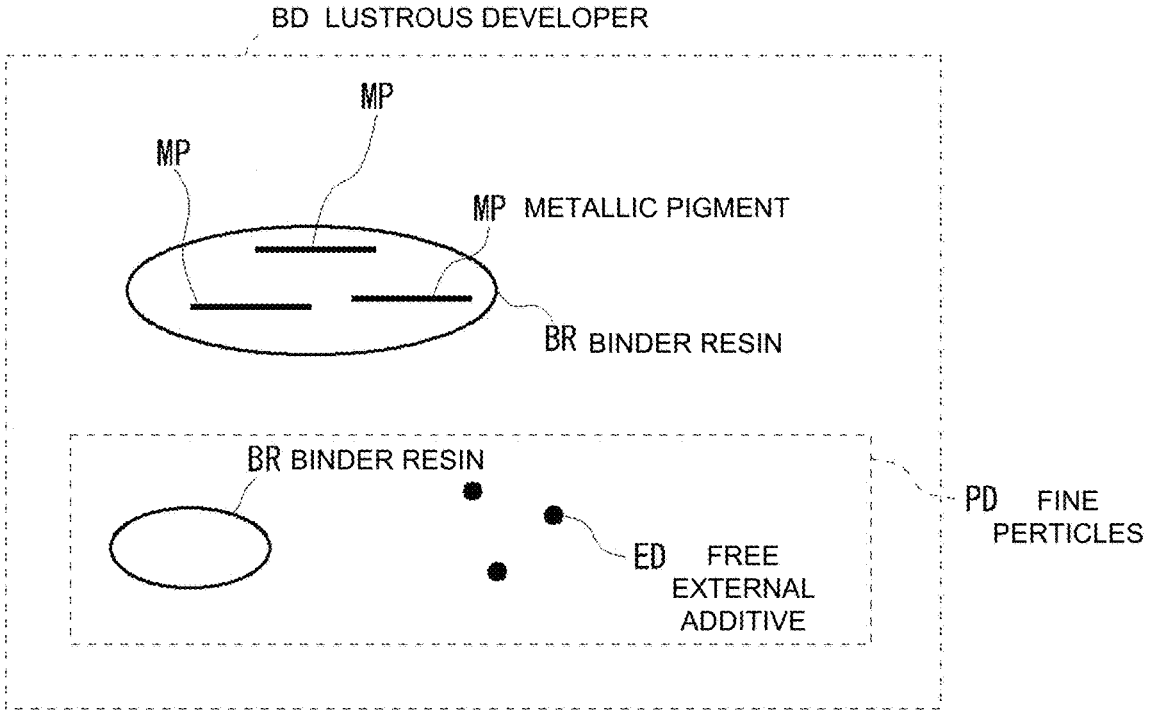
FIG. 11 is a schematic diagram illustrating a configuration of a lustrous developer.

As illustrated in FIG. 11, a lustrous developer BD has fine particles (small diameter particles) PD containing a binder resin BR and free external additive ED that are smaller than the volume median diameter of the metallic pigment MP. Further, the lustrous developer BD is configured such that a ratio of a volume of particles that are not smaller than the volume median diameter of the pigment MP in the developer BD with respect to a volume of the entire lustrous developer BD (that is, the ratio of the volume of particles other than the fine particles PD contained in the lustrous developer BD with respect to the volume of the entire lustrous developer BD) is not less than 90.297% and not more than 99.314%.

Here, if the ratio of the volume of the particles that are not smaller than the volume median diameter of the pigment in the developer with respect to the volume of the entire developer is smaller than 90.297%, the ratio of the fine particles PD with respect to the entire lustrous developer BD increases. In other words, since the ratio of the fine particles PD that does not contain the metallic pigment MP increases on the paper, that part on the paper is seen as the transfer dropout, and thus the print image quality is judged as poor in the transfer dropout judgement. On the other hand, if the ratio of the volume of the particles that are not smaller than the volume median diameter of the pigment in the developer with respect to the volume of the entire developer is larger than 99.314%, the ratio of the fine particles PD to the entire lustrous developer BD decreases.

The fine particles PD refer to the particles that do not contain the metallic pigment MP and the external additives liberated from the toner base particles (free external additives ED). The particles that do not contain the metallic pigment MP have high chargeability because they do not contain the metallic pigment MP, which decreases the chargeability. The particles that do not contain the metallic pigment MP and the free external additives ED have high changeability because they have smaller particle sizes and thus have a larger surface area in total than that of the metallic pigment particles MP. In other words, since the metallic pigment MP which has low-chargeability and the free external additives ED which have high-chargeability affect the chargeability of the entire lustrous developer BD, the lustrous developer BD becomes low-charged in the first place and thus may not be properly transferred, resulting in poor printing results.

Therefore, it may be important to define the ratio of the volume of the particles other than the fine particles PD contained in the lustrous developer BD with respect to the volume of the entire lustrous developer BD to be 90.297% or more and 99.314% or less.

Accordingly, the image formation apparatus 1 using such a lustrous developer BD can improve the charge retention capacity due to the increased surface area of the lustrous developer BD, and can reduce the amount of the lustrous developer particles BD that are caught together and thus are dropped out. Therefore, the image formation apparatus 1 using the lustrous developer BD can reduce the transfer dropout, so as to realize high-definition printing with print defects being reduced.

In the image formation apparatus 1, the volume median diameter of the metallic pigment MP is set to 5.91 μm or less. Even more preferably, the lustrous developer BD is configured such that the ratio of the volume of the particles whose particle sizes are not less than the volume median diameter of the pigment in the developer with respect to the volume of the entire lustrous developer BD is 90.733% or more and 97.682% or less, which can realize an improved image quality with the transfer dropout being reduced. As a result, the image formation apparatus 1 can further improve the print image quality with the transfer dropout being further reduced.

In the image formation apparatus 1, the volume median diameter of the effective components of the developer is set to be 8.81 μm or more and 15.81 μm or less. As a result, the image formation apparatus 1 can further improve the print image quality with the transfer dropout being further reduced.

Thus, regarding the lustrous developer used in the image formation apparatus 1 according to an embodiment, the ratio of the volume of the particles having particle sizes not less than the volume median diameter of the pigment in the developer with respect to the volume of the entire developer, the volume median diameter of the metallic pigment, and the volume median diameter of the effective components in the developer are appropriately determined. With this, the image formation apparatus 1 can form the high-quality print image with the transfer dropout being reduced.

According to the above configuration, the image formation apparatus 1 according to an embodiment contains a lustrous developer D in the developer container 12 of the image formation unit 10S. The developer D includes a metallic pigment and a binder resin, wherein the developer includes fine particles that have particle sizes smaller than the volume median diameter of the metallic pigment, wherein the ratio of the volume of particles other than the fine particles in the developer D with respect to the volume of the entire developer D is 90.297% or more and 99.314% or less, and the volume median diameter of the metallic pigment is 5.91 μm or less.

Therefore, the image formation apparatus 1 using such a developer D can form a print image in which a transfer dropout is suppressed, and can form a high-quality image on a medium.

9. Other Embodiments

In one or more embodiments described above, the case has been described in which the aluminum (Al), which is contained in the lustrous pigment used for producing the developer D, is formed of the minute flakes having flat portions. However, the disclosure is not limited thereto, and the aluminum may be formed of small flakes having another shape, such as, for example, a sphere shape, a rod shape, and/or the like.

In one or more embodiments described, the case has been described in which the metal contained in the lustrous pigment used for producing the developer D is aluminum (Al). However, the disclosure is not limited thereto, and the metal may be any metal, such as brass, iron oxide, or the like, for example. In this case, a color expressed by the developer that is fixed on the paper P will correspond to the color of the metal.

Furthermore, in one or more embodiments described above, the case has been described where the invention is applied to the developer of the single component development type. The disclosure is not limited thereto, and may be applied, for example, to a developer of a two-component develop type using a carrier.

Furthermore, in one or more embodiments described above, the case has been described where the five image formation units 10 are provided in the image formation apparatus 1 or 101 (FIG. 1 or FIG. 18). However, the disclosure is not limited thereto. For example, the image formation apparatus 1 or 101 may be provided with less than five of the image formation units 10 or with more than five of the image formation units 10.

Furthermore, in one or more embodiments described above, the case has been described where the invention is applied to the image formation apparatus 1 or 101, which is a single function printer. However, the disclosure is not limited thereto, and may be applied to an image formation apparatus having another function, such as a copier, a facsimile, or an MFP (Multi Function Peripheral) having functions of a copier, a facsimile, and the like, for example.

Further, in one or more embodiments described above, the case of applying the invention to the image formation apparatus 1 or 101 has been described. However, the disclosure is not limited thereto. For example, the invention may be applied to various electronic devices, such as photocopiers and the like, which form images on paper P or other media using the developer D by an electrophotographic method.

Furthermore, the invention is not limited to one or more embodiments described above. That is, the application range of the invention covers embodiments obtained by arbitrarily combining some of or all of embodiments described above and the other embodiments described above as well as embodiments obtained by extracting a part of the embodiments described above.

Further, in one or more embodiments described above, the case has been described where the image formation apparatus 1 is configured to include the image formation units 10 as a development device including the photosensitive drum 36 as an image carrier and the developing roller 34 as a developer carrier, and the fixation unit 70 as a fixation device. However, the disclosure is not limited thereto, and an image formation apparatus may be configured to include a development device including an image carrier and a developer carrier, and a fixation device that are formed in other configurations.

The disclosure can be used for forming an image on a medium using a developer containing a metallic pigment by an electrophotographic method.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A lustrous developer comprising:

a toner including a metallic pigment; and a binder resin, wherein the lustrous developer includes small diameter developer particles whose particle sizes are smaller than a volume median diameter of the metallic pigment, wherein the volume median diameter of the metallic pigment is 5.91 μm or less, a ratio of a volume of developer effective components, which correspond to the particles other than the small diameter developer particles in the lustrous developer, to a volume of the entire lustrous developer is 90.297% or more and 99.314% or less, and a volume median diameter of the developer effective components is 8.81 μm or more and 15.81 μm or less.

2. The lustrous developer according to claim 1, wherein the volume median diameter of the metallic pigment is 5.44 μm or more and 5.91 μm or less.

3. The lustrous developer according to claim 2, wherein the ratio of the volume of the developer effective components, which correspond to the particles other than the small diameter developer particles in the lustrous developer, to the volume of the entire lustrous developer is 90.733% or more and 97.682% or less.

4. The lustrous developer according to claim 1, wherein the small diameter developer particles include the binder resin and an external additive.

5. The lustrous developer according to claim 1, wherein the volume median diameter of the developer effective components is calculated from a first part of a volume particle size distribution of the lustrous developer that is remained after a second part of the volume particle size distribution of the lustrous developer that is smaller than a first particle diameter has been removed, wherein the first particle diameter is obtained by measuring a volume median diameter of extracted particles which are extracted from the lustrous developer, wherein the extracted particles are obtained by removing an external additive from the lustrous developer to obtain a first residue, dissolving the first residue in tetrahydrofuran, and removing the tetrahydrofuran from the dissolved first residue so as to obtain a second residue as the extracted particles.

6. A developer container that contains therein the lustrous developer according to claim 1.

7. A development device comprising:

an image carrier configured to form a latent image by being exposed by light; and a developer carrier configured to supply the lustrous developer according to claim 1 to the latent image to develop a developer image on the image carrier.

8. An image formation apparatus comprising:

the development device according to claim 7; and a fixation device configured to fix the developer image formed by the development device to a medium.

9. The lustrous developer according to claim 1, wherein the volume median diameter of the metallic pigment is the volume median diameter of the metallic pigment that is extracted from the lustrous developer.

10. The lustrous developer according to claim 1, wherein the volume median diameter of the metallic pigment is the volume median diameter of the metallic pigment that is extracted from the lustrous developer, wherein the extracted metallic pigment is obtained from a residue, which is obtained by removing an external additive from the lustrous developer such that a difference between a content rate of silicon in the residue and a content rate of silicon in the lustrous developer is greater than 0.21%.

11. The lustrous developer according to claim 1, wherein the volume median diameter of the metallic pigment is the volume median diameter of the metallic pigment that is extracted from the lustrous developer, wherein the extracted metallic pigment is obtained by removing an external additive from the lustrous developer to obtain a first residue in such a manner that a difference between a content rate of silicon in the first residue and a content rate of silicon in the lustrous developer is greater than 0.21%, dissolving the first residue in a predetermined solution, and removing the predetermined solution from the dissolved first residue so as to obtain a second residue as the extracted metallic pigment.

* * * * *